US005775529A

United States Patent [19]

Lo

[11] Patent Number: 5,775,529

[45] Date of Patent: Jul. 7, 1998

[54] DECORATING GLASS VESSEL FILLED WITH WATER

[76] Inventor: Szu Wei Lo, 7F-1, No. 3, Lane 173, Liu-Ho Road, Pu-Li Chen, Nan-Tou Hsien, Taiwan

[21] Appl. No.: 761,614

[22] Filed: Dec. 6, 1996

[51] Int. Cl.[6] ..... A01G 5/04; A47G 7/02; B65D 23/12; B65D 39/04

[52] U.S. Cl. ..... 215/270; 215/271; 215/358; 47/69

[58] Field of Search ..... 215/260, 261, 215/262, 270, 271, 358, 355, 381–384; 220/240, 609, 624; 47/69; 446/236, 267, 358; 40/409, 410; 206/423

[56] References Cited

U.S. PATENT DOCUMENTS

| | | | |
|---|---|---|---|
| 2,155,811 | 4/1939 | Tredup | 47/69 X |
| 2,226,951 | 12/1940 | Simpson | 47/69 X |
| 2,361,423 | 10/1944 | Snyder | 40/410 |
| 2,601,658 | 6/1952 | Bussert | 47/69 X |
| 2,686,642 | 8/1954 | Dobarganes et al. | 47/69 X |
| 2,724,213 | 11/1955 | Weil | 47/69 X |
| 2,746,632 | 5/1956 | Bramming | 215/270 |
| 4,293,078 | 10/1981 | Percarpio et al. | 215/270 X |
| 4,771,902 | 9/1988 | Teng | 40/410 X |
| 5,110,636 | 5/1992 | Hou | 446/267 X |
| 5,321,908 | 6/1994 | Ushimaru | 47/69 |

FOREIGN PATENT DOCUMENTS

| | | | |
|---|---|---|---|
| 1197330 | 11/1959 | France | 215/270 |

*Primary Examiner*—Stephen Cronin
*Assistant Examiner*—Nathan Newhouse
*Attorney, Agent, or Firm*—Morton J. Rosenberg; David I. Klein; Jun Y. Lee

[57] ABSTRACT

A decorating glass vessel is disclosed. In particular, It relates to a spherical shape decorating vessel filled with water. The glass vessel is disposed with an opening which has extended with a circular wall upward to a preset height. A soft cover can be inserted into the circular wall such that a frictional engagement is attained between the circular wall and the cover. The water facing surface of the cover is provided with an elevated surface. The other portion of the water facing surface except the elevated surface is provided with at least one thinner portion with thinner thickness. The thinner portion can be readily deformed to absorb the increased hydraulic pressure resulted from temperature gradient. Consequently, the water or air leakage resulted therefrom can be therefore avoided.

2 Claims, 4 Drawing Sheets

DECORATING GLASS VESSEL FILLED WITH WATER

FIELD OF THE INVENTION

The present invention relates to a decorating glass vessel, wherein the water facing surface of the cover has a thinner portion which defines a membrane which can be readily deformed when hydraulic pressure is applied thereof.

DESCRIPTION OF PRIOR ART

As shown in FIG. 1, a conventional decorating glass vessel which has an opening 11 at the top of the glass vessel 1. The edge of the opening 11 extends upward to define a circular wall 12 along its peripheral portion. The circular wall 12 has a preset height and a recessed groove 13 is defined along the circular wall 12. The glass vessel 1 is firstly filled with water 14, then a cover 15 provided with a decorating articles 152 at its upper surface 151 is inserted into the glass vessel 1 such that the projected rib 153 of the cover 15 is engaged with the recessed groove 13 of the circular wall 12. Besides, the water level is set such that part of the water 14 will egress from the vessel 1 to eliminate any air or bubbles within the vessel 1. When the cover 15 is correctly positioned, the vessel 1 is inverted 180 degree (upside down) such that the cover 15 become the bottom of the vessel 1, accordingly, an aesthetic and genuine glass decorating article is provided.

Nevertheless, the glass vessel 1 is made from blowing method, accordingly, it has a poor overall accuracy, especially on the circular wall 12. The circularity of the wall 12 is comparatively lower than those made form machine cutting. In some case, it can be an olive or irregular shape. Consequently, in order to establish a fluid seal between the cover 15 and the circular wall 12 to prevent any leakage thereof, the cover 15 is made from soft rubber and the outer diameter of the cover 15 is slightly larger than the inner diameter of the wall 12. In assembling, the cover 15 is forcibly inserted into the wall 12. Even by this arrangement, the slit can still be found between the cover 15 and the wall 12. Because the water 14 is almost incompressible under a general indoor temperature, when the ambient temperature raises, the volume of the water 14 within the vessel 1 may expand, i.e. the pressure within the vessel 1 increases. Consequently, the water 14 may leak through those slits. When the temperature lowers, the volume of water 14 shrinks and air can be sucked into the vessel 1. Accordingly, the introduced air or bubbles will collect in the ceiling of the vessel 1 which is originally filled with water. This may bring a negative appearance to the glass vessel 1. This can be referred to a defective product which is unaccented by the customer. Normally, the customer may ask to replace it with a new one or refund. According to the statistic, the defective products ranges about 20% to 30% among the total products. It is a very serious problem.

SUMMARY OF THE INVENTION

It is the object of this invention to provide a decorating glass vessel wherein the problem encountered by the conventional vessel can be completely solved.

According to one aspect of the invention, the water facing surface of the cover has a thinner portion which defines a membrane which can be readily deformed when hydraulic pressure is applied thereof. Accordingly, the expansion or shrinkage of water volume resulted from temperature gradient can be compensated by the deformation of the membrane. Consequently, the inner hydraulic pressure within the vessel is maintained almost in a constant state, the leakage resulted from pressure differential is prevented.

TECHNIQUE APPLIED

A decorating glass vessel comprises a spherical vessel having an opening thereof. The peripheral of the opening is extended upward to define a circular wall having a preset height. The vessel is filled with water and a cover can be inserted into the circular wall such that a frictional water sealed engagement between the cover and the circular wall is attained. The water facing surface of the cover is disposed with a decorating articles which are immersed within the water. Characterized in that the cover has an central elevated portion for disposing the decorating articles while the rest area is at least provided with a membrane which has a thinner thickness that the central portion.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
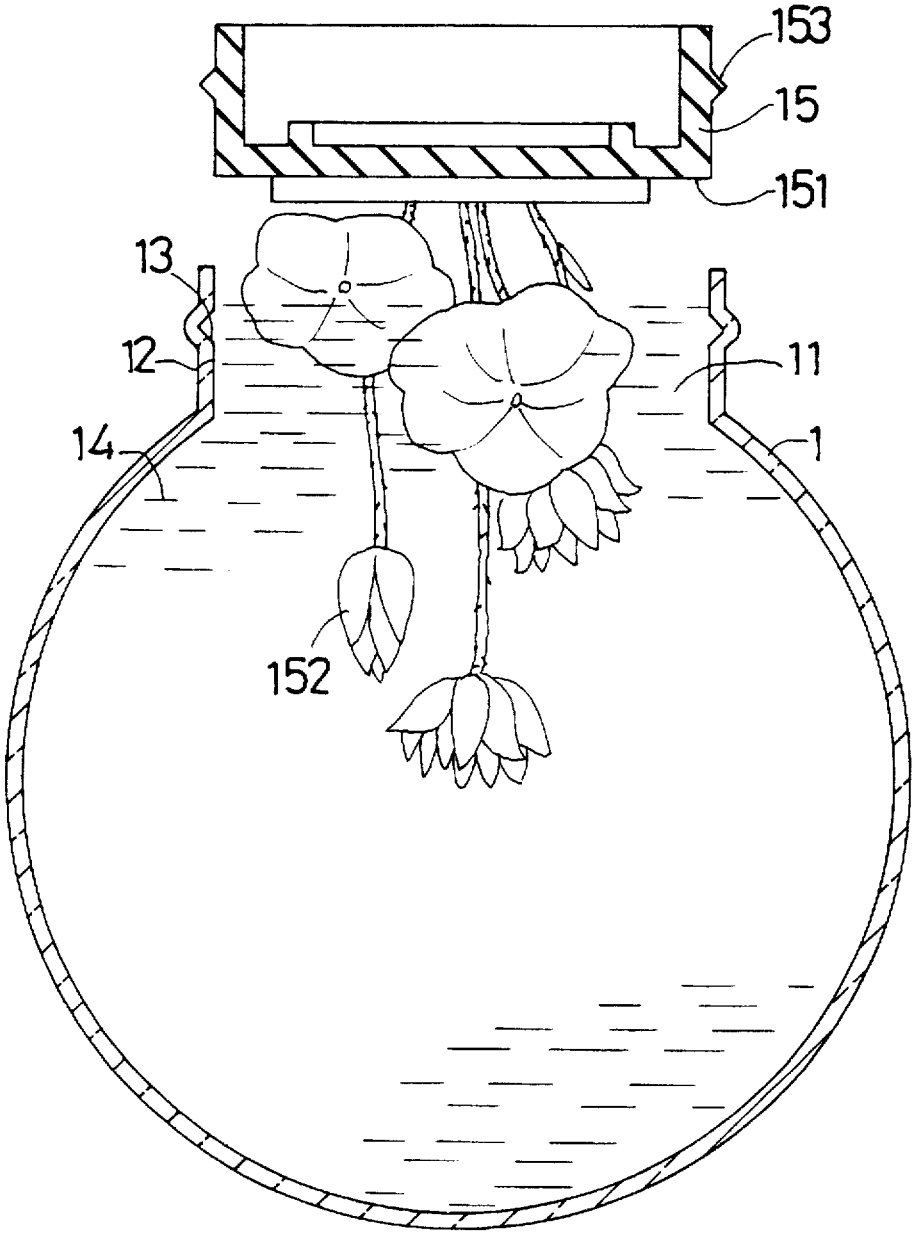
PRIOR ART FIG. 1
FIG. 1 is a cross sectional view showing a conventional decorating glass vessel thereof.
Figure 3:
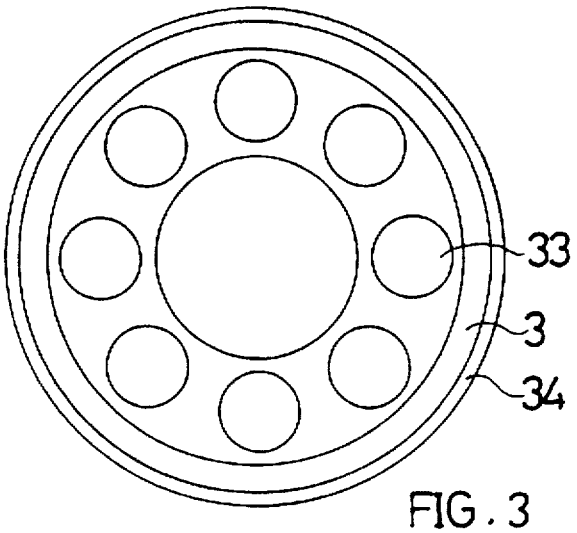
FIG. 3 is a bottom view of the cover made according to this invention.
Figure 2:
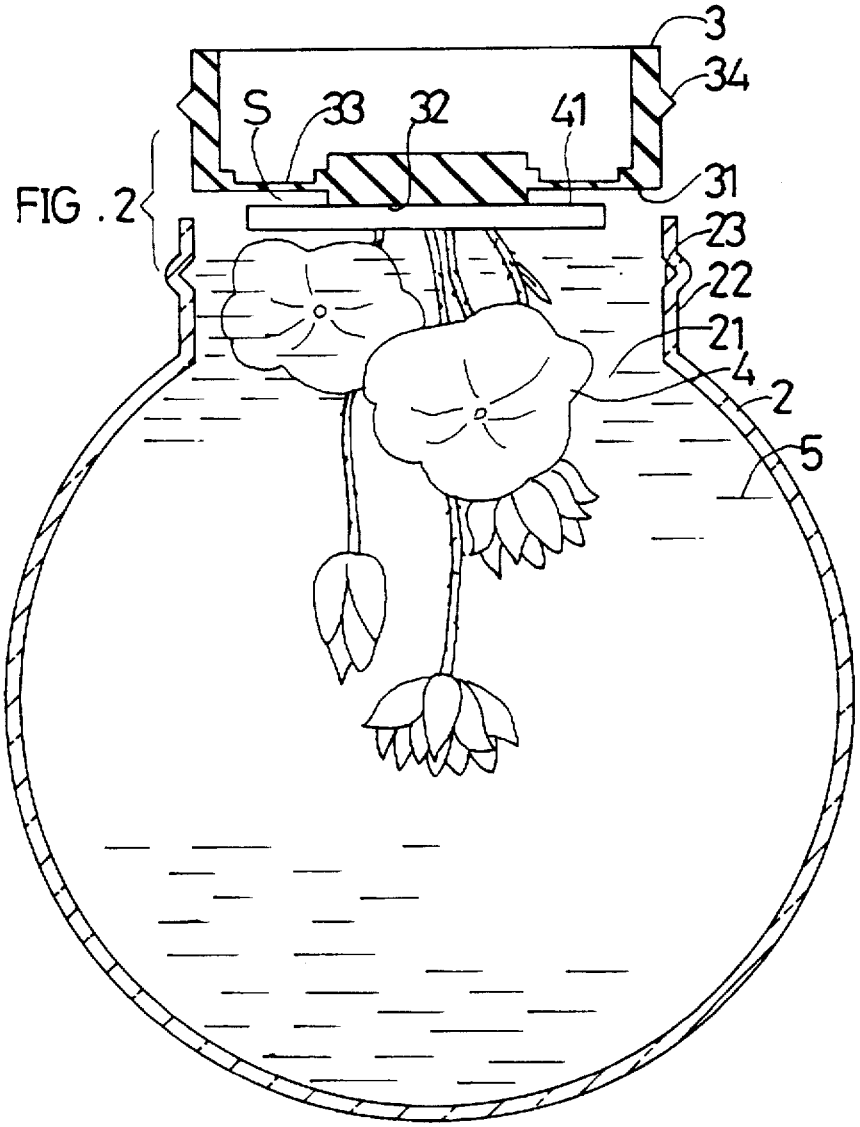
FIG. 2 is a cross sectional view showing the assembling of the decorating glass vessel made according to this invention.

Referring to FIGS. 2 and 3, an illustrative example has been described merely for explanation while not intended for any limitation thereof.

The decorating glass vessel made according to this invention generally comprises a glass vessel 2, a cover 3, a decorating articles, and water 5.

The glass vessel 2 has a circular opening 21 atop. A circular wall 22 which extends upward from the peripheral of said opening 21. The circular wall 22 is provided with a recessed groove 23. When the water 5 is filled into the glass vessel 2, the water level reaches to the position on circular wall 22.

The cover 3 has a circular configuration having its outer diameter slightly larger than the inner diameter of the circular wall 22 of the glass vessel 2. The cover 3 has an elevated plane 32 in the center of the water facing surface 31. A decorating article 4 can be disposed at said elevated plane 32. A distance S has been set between the bottom 41 of the decorating article 4 and the water facing surface 31 of the cover 3. In the area of the water facing surface 31 except to the elevated plane 32, at least a thinner portion 33 is provided. In the preferred embodiment of the present invention, eight thinner portions 33 have been provided. Of course, the number and shape of the thinner portion can be altered according the dimension of the glass vessel 2. The thinner portion 33 can be referred to as a membrane as compared with the elevated plane. Referred to FIG. 3, the thinner portion 33 has an olive shape and is equal-angularly disposed at the area between the peripheral and the surface 32 of the upper plane 31. The outer wall of the cover 3 is provided with projected rib 34 which can be securely retained within the recessed groove 23 of the circular wall 22.

Figure 4:
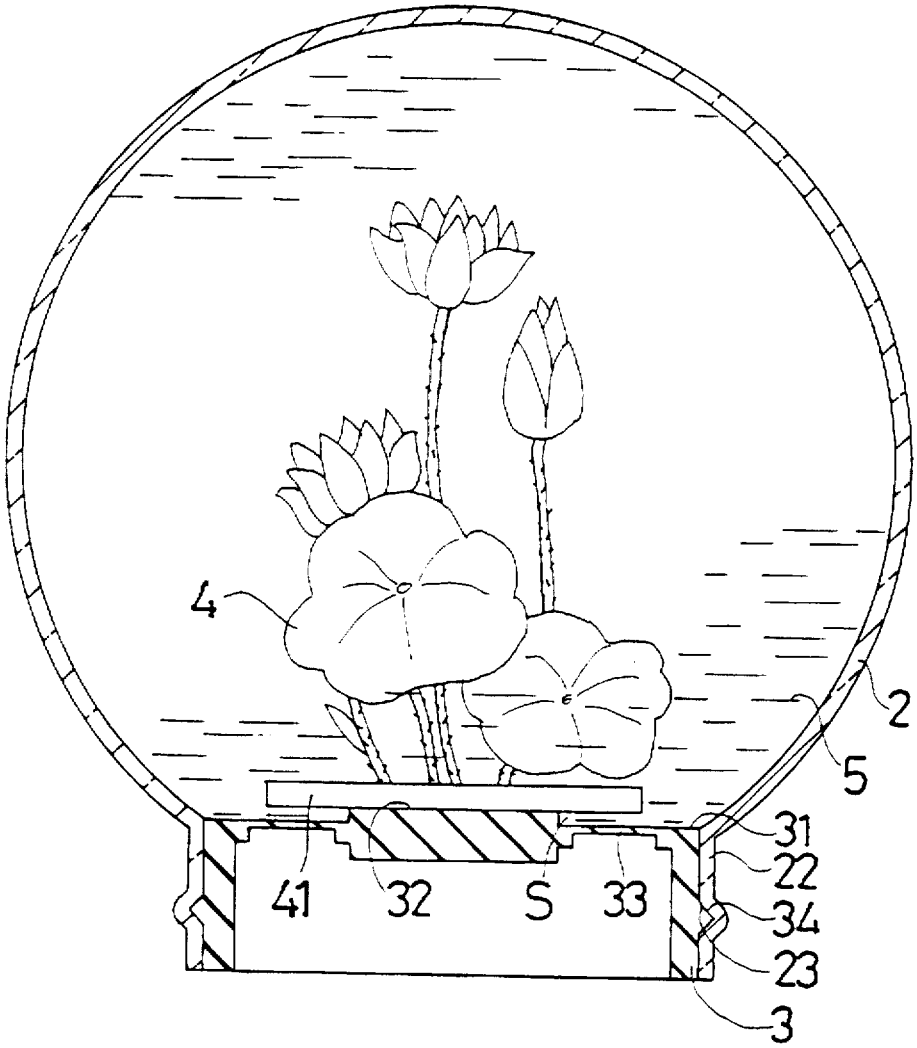
FIG. 4 is a cross sectional view showing an assembled decorating glass vessel made according to this invention.

Referred to FIG. 4, the cover 3 is inserted into the circular wall 22 while excess water and air will be squeezed out such that there is no air within the water 5 filled in the glass vessel 2. Then, the cover 3 is pushed further such that the projected rib 34 of the cover 3 is securely received and retained within the recessed groove 23 of the circular wall 22. By this arrangement, a water tight or seal may establish between the cover 3 and the circular wall 22 of the opening 21. Afterward, the glass vessel 2 is inverted such that the cover 3 is located in the bottom while the decorating article is erected within the water such that an aesthetic appearance is attained.

Figure 5:
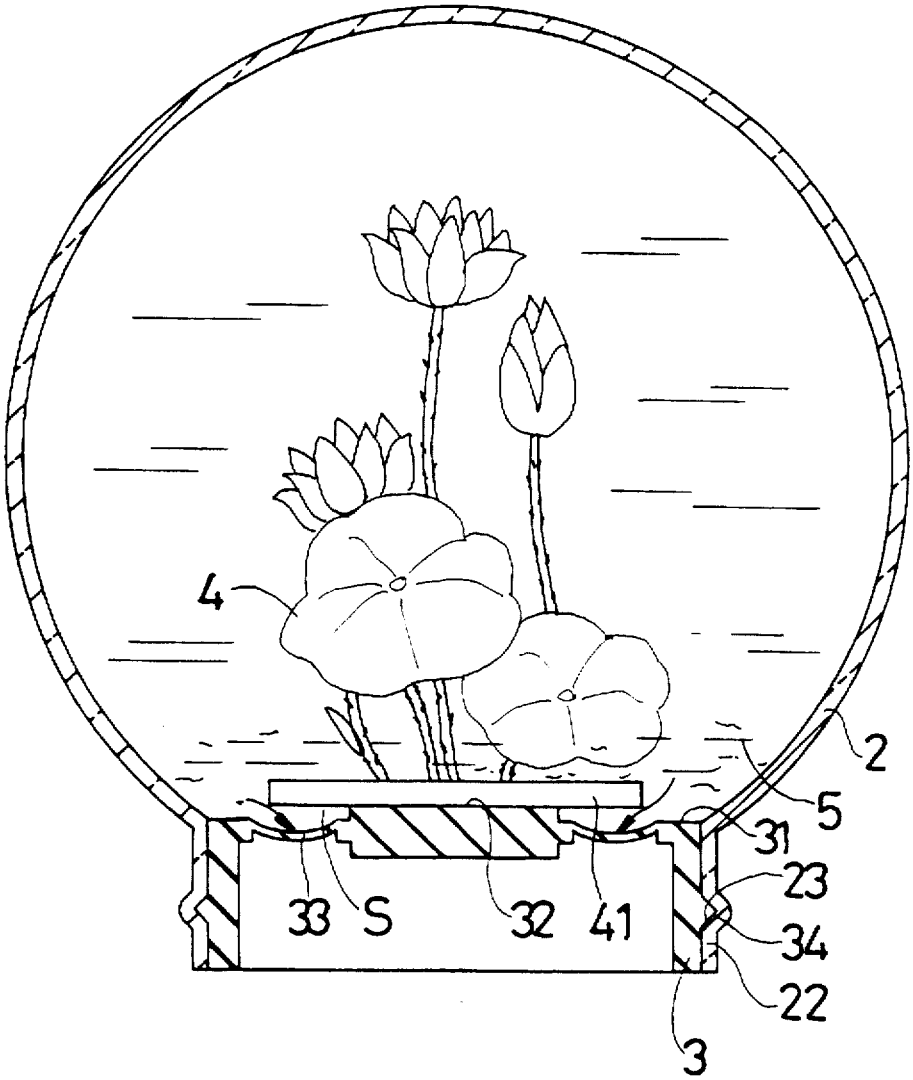
FIG. 5 is a schematic illustration showing the cover is applied with hydraulic pressure.

It shall be specially noted, as shown in FIG. 5, the water facing surface 31 of the cover 3 is provided with an elevated plane 32 which has a shoulder with the water facing surface 31. When the decorating article 4 is disposed at the elevated plane 32, the bottom 41 of the decorating article 4 may has a distance S with the water facing surface 31 of the cover 3. The distance S is just located above the thinner portion 33 of the water facing surface 31 of the cover 3. When there is a water expansion resulted from the temperature gradient, the pressure is transferred to the thinner portion 33 via the S distance. Since the thickness of the thinner portion 33 is quite thin, it can be readily deformed when hydraulic pressure is applied thereof. Consequently, the increased volume of water 5 can be adequately absorbed by the deformation of the inner portion 33. Accordingly, the increased pressure resulted from temperature gradient is diminished. As a result, no water may leak through the slits between the circular wall 22 and the cover 3. By this arrangement, no air will be introduced into the glass vessel 2 since no loss of water 5. The bubbles problem encountered by the conventional glass vessel is completely solved.

By the provision of the thinner portion 33, the increased volume of water 5 can be readily absorbed by the deformation of the thinner portion 33. Consequently, the defective rate of the products is reduced.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. A decorative glass vessel, comprising:

a substantially spherical vessel having an opening formed therein, said vessel having a circular wall extending a predetermined distance therefrom and circumscribing said opening, said vessel being filled with water; and, a cover sealingly engaged with said circular wall and having an end wall forming a closure for said opening, said end wall having a centrally disposed first surface portion substantially surrounded by a second surface portion, said second surface portion contacting the water in said vessel and said first surface portion being spaced from said second surface portion for supporting a decorative article thereon for immersion in the water in said vessel, said end wall of said cover having at least one region of substantially reduced thickness formed in said second surface portion, said at least one region having a thickness thinner than a thickness of a remaining portion of said second surface portion to define a membrane for displacement responsive to thermally induced changes in pressure within said vessel.

2. The decorative glass vessel as recited in claim 1 where said end wall has a plurality of regions of substantially reduced thickness disposed in angularly spaced relationship in said second surface portion to define a plurality of membranes surrounding said first surface portion and radially spaced therefrom for displacement responsive to said thermally induced changes in pressure within said vessel.

* * * * *